United States Patent [19]

Hurtig

[11] Patent Number: 4,593,585

[45] **Date of Patent: * Jun. 10, 1986**

[54] ADJUSTABLE WRENCH

[75] Inventor: Carl R. Hurtig, Cohasset, Mass.

[73] Assignee: Encor, Limited, Cohasset, Mass.

[ * ] Notice: The portion of the term of this patent subsequent to Dec. 18, 2001 has been disclaimed.

[21] Appl. No.: 663,554

[22] Filed: Oct. 22, 1984

Related U.S. Application Data

[62] Division of Ser. No. 323,658, Nov. 20, 1981, Pat. No. 4,488,461.

[51] Int. Cl.[4] ..... B25B 13/28

[52] U.S. Cl. ..... 81/98; 81/77; 81/109

[58] Field of Search ..... 81/98–100, 81/106, 108, 109, 77, 119, 125.1, 177 R

[56] References Cited

U.S. PATENT DOCUMENTS

| | | | |
|---|---|---|---|
| 282,768 | 8/1883 | Pollard . | |
| 453,537 | 6/1891 | Bates et al. . | |
| 909,101 | 1/1909 | Longdin . | |
| 1,123,462 | 1/1915 | Anderson et al. . | |
| 1,286,926 | 12/1918 | Brightly . | |
| 1,380,822 | 6/1921 | Mason . | |
| 1,436,698 | 11/1922 | Croft et al. . | |
| 1,754,717 | 4/1930 | Hughens | 81/98 |
| 2,506,373 | 5/1950 | McClain . | |
| 2,748,640 | 6/1956 | Alexander . | |
| 3,023,652 | 3/1962 | Feldman . | |
| 3,670,604 | 6/1972 | Frommell | 81/98 |
| 4,151,763 | 5/1979 | Colvin | 81/77 |

FOREIGN PATENT DOCUMENTS

| | | | |
|---|---|---|---|
| 69620 | 7/1949 | Denmark | 81/128 |
| 1958614 | 5/1971 | Fed. Rep. of Germany . | |
| 5196 | of 1913 | United Kingdom . | |
| 26212 | of 1914 | United Kingdom . | |

*Primary Examiner*—Frederick R. Schmidt
*Assistant Examiner*—Debra S. Meislin
*Attorney, Agent, or Firm*—Weingarten, Schurgin, Gagnebin & Hayes

[57] ABSTRACT

A continuously adjustable wrench suitable for use with a range of nut or bolt head sizes and having a handle which is offset or angularly disposed with respect to the wrench head. The wrench provides contact with the nut or bolthead at three spaced, opposing points such that the rotational torque imparted thereto is optimized and the strength required for the wrench head for a given torque is reduced. In one embodiment, the wrench head is pivotally disposed with respect to the handle either about a single pivot or a double pivot to drive a camming contact surface on the handle into contact with a confronting surface of the nut or bolthead. In another embodiment, a contact surface is adjustable longitudinally along the handle to be positioned adjacent the nut or bolthead. In a further embodiment, a wrench head is disposed at each end of the handle, and an adjustment screw is provided on the handle for sliding the handle with respect to the wrench heads for continuously adjusting both wrench heads simultaneously. The wrench heads of this embodiment may be either pivotally or non-pivotally disposed with respect to the handle.

2 Claims, 18 Drawing Figures

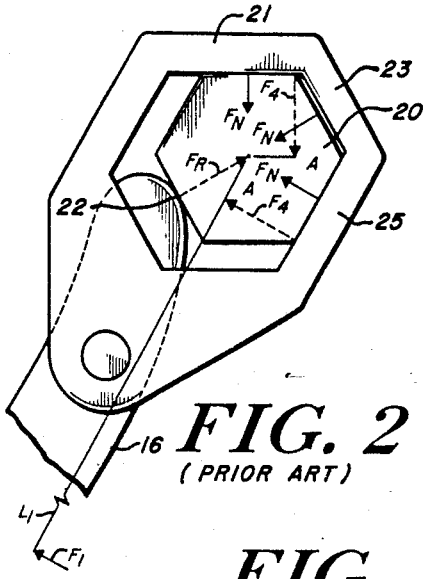
FIG. 2
(PRIOR ART)
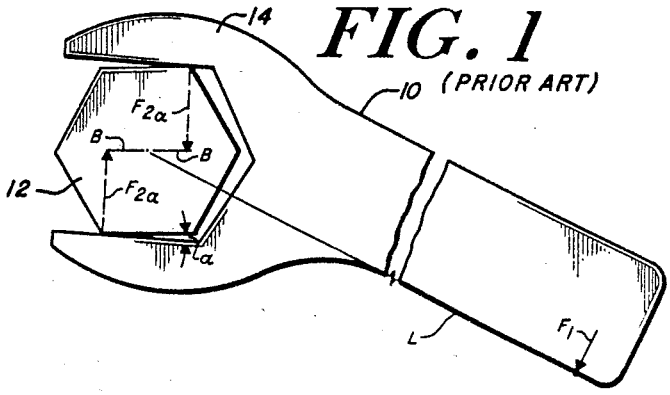
FIG. 1
(PRIOR ART)
FIG. 3A
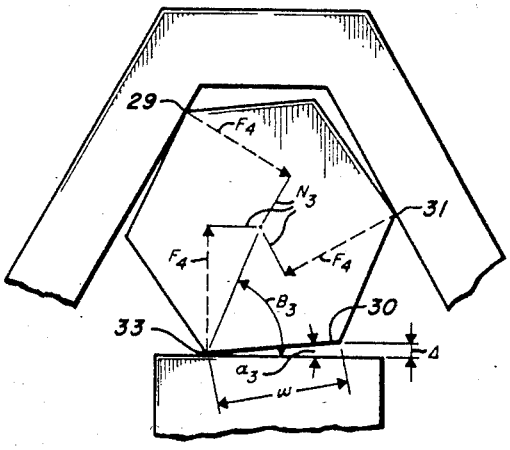
FIG. 3
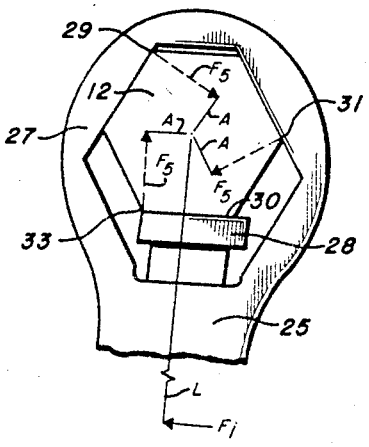
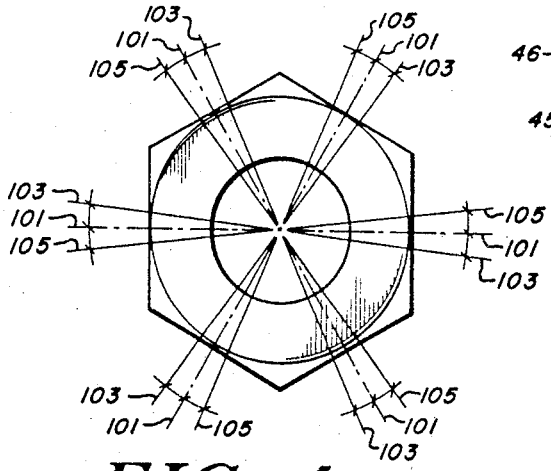
FIG. 4
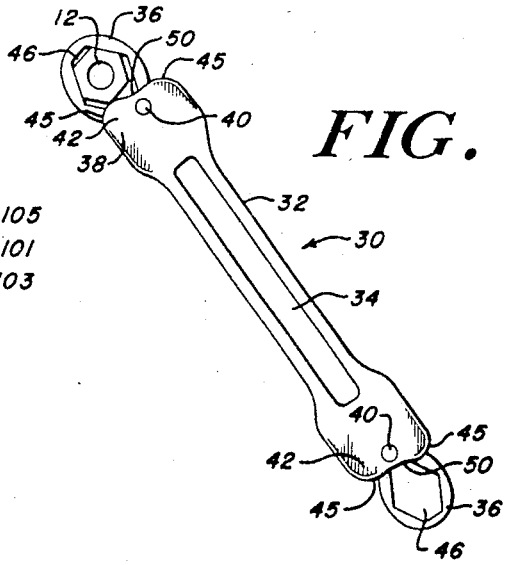
FIG. 5

FIG. 6
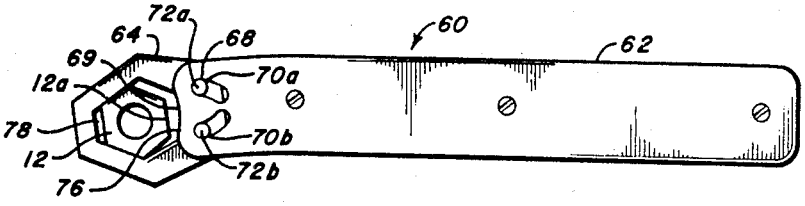
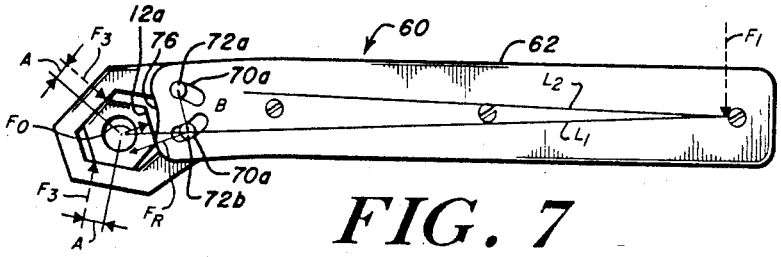
FIG. 7
FIG. 8
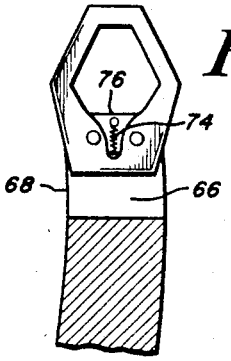
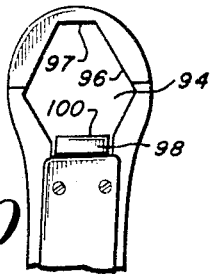
FIG. 10
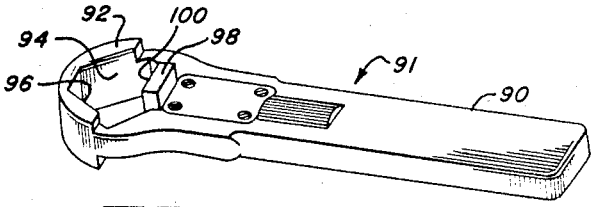
FIG. 9
FIG. 11
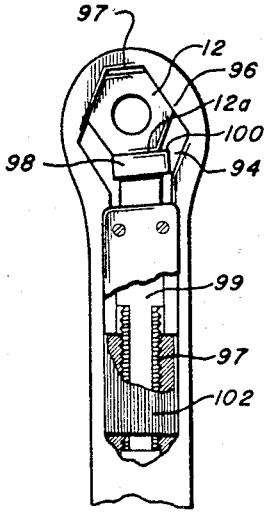
FIG. 12
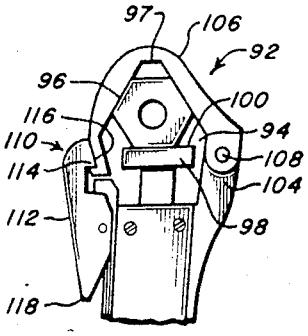

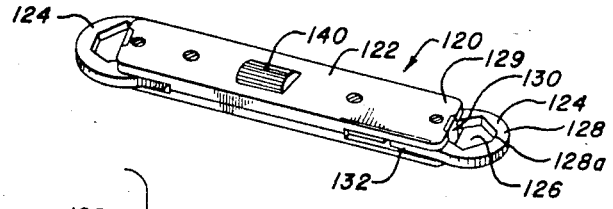
FIG. 13
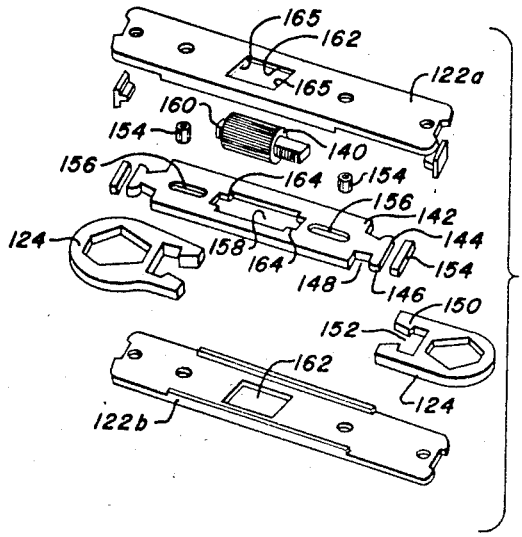
FIG. 14
FIG. 15
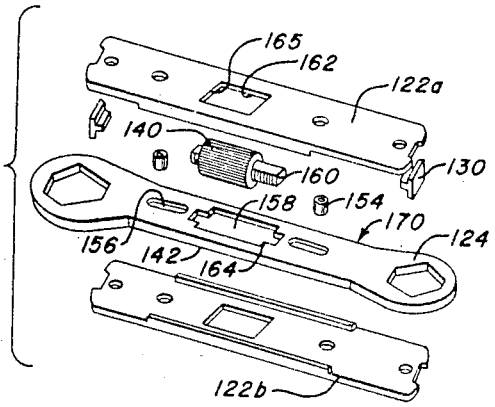
FIG. 16
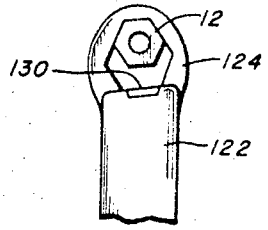
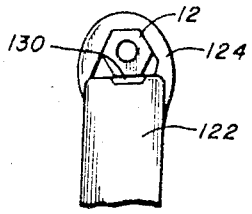
FIG. 17

ADJUSTABLE WRENCH

This is a division of application Ser. No. 323,658 filed on Nov. 20, 1981 now U.S. Pat. No. 4,488,461.

FIELD OF THE INVENTION

The present invention relates generally to wrenches and more particularly concerns offset, continuously adjustable wrenches providing of three point contact.

BACKGROUND OF THE INVENTION

Adjustable, hand held wrenches are available in a variety of sizes and designs and are well known both to those skilled in the art and to the layman. One of the most commonly used of such wrenches is the two surface adjustable wrench, including the so-called crescent wrench. Examples of various types of two surface adjustable wrenches are described in the following U.S. Pat. Nos.: 1,127,100; 2,018,047; 3,198,041; 3,659,485; 3,563,118; 3,599,516; 3,802,303; 4,011,778; 391,532; and 784,876. The two surface adjustable wrench, however, has a number of drawbacks which render it awkward to use and which often preclude its use in certain situations. One drawback is that it is often impossible in blind situations to determine which direction the wrench adjustment screw must be rotated to either open or close the wrench jaws. Another drawback is that the wrench has a preferred direction of rotation under high torque applications to obtain the optimal coupling action between the nut or bolthead and the wrench, and space limitations often prevent the wrench from being used in its preferred direction. The major limitation of such a wrench is its inability to remove nuts or boltheads under high torque conditions. This limitation is partially a result of the fact that a two surface adjustable wrench applies torque to the nut or bolthead at only two points. In addition, as a result of many factors such as slippage of the adjustment, the spring characteristiscs of the jaws, burrs and so forth on either the faces of the jaws or on the nut, and dirt or grease on the wrench head faces or nut faces, the actual moment arms are reduced from a maximum value to a smaller value because of rotation of the wrench head with respect to the nut. To apply a given torque, an increased force must be applied to the corners of the nut because of the reduction of the moment arm. This increased force is often sufficient to begin a rounding off of the corners which often produces an angle of the wrench handle with respect to the nut which reduces the moment arm even more. Often, this process degenerates to the point where the wrench will no longer grip the nut and damage to the user's hand can result. In addition, because of the two point contact and rotation of the wrench head with respect to the nut, the wrench head must be capable of withstanding great forces in high torque situations, and this necessitates thick wrench head walls. These thick walls render the wrench very difficult to maneuver and use in limited space applications.

Some of these disadvantages of the crescent wrench have been overcome by known self-camming wrenches, or wrenches having pivotally disposed wrench heads. Examples of such wrenches are described in U.S. Pat. Nos. 2,506,373; 3,023,652; 909,101; 1,380,822; 282,768; 453,537; 1,436,698; Danish Pat. No. 69,620; German Pat. No. 1,958,614 and British Pat. No. 5,196. Many of the above self-camming wrenches are not suitable for hexagonal nuts or boltheads and do not provide a desired offset of the wrench head with respect to the handle. In many of the known self-camming wrenches, particularly the wrench disclosed in the German patent, when the handle is pivoted with respect to the wrenchhead, the camming surface on the handle engages a nut face at the center thereof and provides a force which is directed towards the center of the nut and which drives the nut against opposed walls of the wrenchhead. This inwardly directed force force provides no torque with regard to the nut and tends to deform either the nut or the wrenchhead. The only turning moments acting upon the nut result from forces acting upon the corners of the nut by the opposed walls of the wrenchhead. In addition, this great inwardly directed force necessitates an excessively strong wrenchhead, because of the counterforce which must be applied by the opposed walls of the wrench head. Thus, as with the two surface adjustable wrench, the required thick walls of the wrench head render the wrench very difficult to maneuver and use in limited space applications. Many of these wrenches, particularly the wrench disclosed in the German patent and that found in U.S. Pat. No. 3,023,652 are not bidirectional. Such unidirectional wrenches are awkward to use and must be raised from the nut and inverted before the direction of rotation can be reversed, and in confined areas, it is often difficult to determine whether the wrench is properly oriented with respect to the nut to rotate it in the direction desired. Also, in the unidirectional wrenches, it is only possible to detent the position of the wrench by increments equal to the angular separation of each nut face.

Examples of wrenches and the like having enclosed, non-pivotally attached wrenchheads and a movable jaw for adjusting the size of the wrenchhead opening are disclosed in U.S. Pat. Nos. 2,506,373 and 2,748,640. While such wrenches overcome some of the problems of the crescent wrench and the self-camming wrenches, they provide no means for insuring that the nut or bolthead is secured within the wrenchhead during movement and they provide no offset to the handle.

SUMMARY OF THE INVENTION

This invention generally concerns continuously adjustable wrenches for use with rotatable members such as nuts or boltheads in which the wrench head is typically offset or angularly disposed with respect to the handle and in which rotational torque is applied to the nut or bolthead at three spaced, opposing points in contact with the wrench head. The points at which torque is applied are each spaced from the center of the nut face in the direction of rotation thereof. Thus, the wrenches of this invention are able to provide a greater turning torque without crushing the nut or bolthead or the wrench head in high torque situations than most prior art wrenches, and these wrenches require a lesser wrenchhead mass or wall thickness for a given material and for a given applied force. This lesser wall thickness renders the wrench more maneuverable and easier to use in limited space applications. These wrenches may be used with a wide range of nut or bolthead sizes and are all bidirectional so that the nut or bolthead may be turned in either direction without the necessity of removing the wrench from the nut or bolthead and inverting it. Although described with particular references to hexagonal nuts or bolts, the wrench of this invention can be configured to be used with any other type of rotatable member.

The wrench of this invention has either a wrench head which is pivotable bidirectionally with respect to a handle or one which is fixed with respect thereto. In one pivotable embodiment, a single pivot is provided and a camming contact surface formed on the end of the handle is driven into engagement with a confronting nut face as the wrench head is pivoted with respect to the handle. In another embodiment, a dual pivot is provided permitting the wrench head to pivot about one point as torque is applied to the handle in one direction and to pivot about the other point as torque is applied to the handle in an opposite direction. In either instance, a camming contact surface formed on a confronting end of the handle is driven into engagement with a confronting nut face. In another embodiment, the wrench head is non-pivotably disposed with respect to the handle and a contact surface is formed on a jaw which is movable toward and away from opposed surfaces of in the wrench head opening for capturing a nut or bolthead therein. The contact surface is configured such that it is always generally parallel to the confronting nut face, regardless of the size of the nut. This embodiment may be provided with a hinged two piece wrenchhead which includes a latch for locking the two pieces together during use. In a further embodiment, a wrench head is disposed on each end of the handle, and a contact surface associated with each wrenchhead is formed on the adjacent end of the handle. The size of each wrenchhead opening is adjustable by a screw which slides the handle longitudinally with respect to the two wrench heads to permit accommodation of various size nuts. The two contact surfaces are moved in unison so that as the wrench head opening is enlarged at one end, it is reduced at the other end. The wrench heads of this embodiment may either be pivotally connected to the handle or fixed with respect thereto.

DESCRIPTION OF THE DRAWING

The invention will be more fully understood from the following detailed description taken in conjunction with the accompanying drawing, in which:

FIG. 1 is a schematic representation of the vector forces in a prior art two surface adjustable wrench;

FIG. 2 is a schematic representation of the vector forces in a prior art unidirectional pivotable wrench;

FIG. 3 is a schematic diagram of the vector forces for the wrench head of the present invention for a no gap situation;

FIG. 3A is a schematic diagram of the vector forces for the wrench head of this invention for a gap situation;

FIG. 4 is a schematic representation of the advantages of the offset of the wrench of this invention;

FIG. 5 is a top view of a bidirectional, single pivot wrench of the present invention;

FIG. 6 is a top view of a bidirectional, double pivot wrench of this invention;

FIG. 7 is schematic representation of the vector forces with regard to the wrench of FIG. 6;

FIG. 8 is a partially cutaway view of the wrench of FIG. 6;

FIG. 9 is a pictorial view of another embodiment of the wrench of the present invention having a fixed wrench head;

FIG. 10 is partial top view of the wrench of FIG. 9;

FIG. 11 is a partially cutaway view of the wrench of FIG. 9 in an operative position;

FIG. 12 is a partial top view of an alternative embodiment of the wrench of FIG. 9;

FIG. 13 is a pictorial view of another embodiment of the wrench of this invention having a wrench head at each end of the handle member and longitudinally adjustable camming surfaces;

FIG. 14 is an exploded view of one embodiment of wrench of FIG. 13 having pivotally disposed wrench heads;

FIG. 15 is an exploded view of another embodiment of the wrench of FIG. 13 having non-pivotally disposed wrench heads;

FIG. 16 is a partial top view of the wrench of FIG. 13 in which the cam surface is retracted; and FIG. 17 is a partial top view of the wrench of FIG. 13 in which the cam surface is advanced into engagement with a nut within the wrench head.

DETAILED DESCRIPTION OF THE INVENTION

With reference now to the drawing, and more particularly FIGS. 1, 2, 3 and 3A thereof, the forces associated with the wrench of the present invention will be compared with those present in certain prior art wrenches. FIG. 1 represents a typical vector diagram of the forces for a two surface adjustable wrench when used on a hexagonal nut. The torque applied to the end of the wrench handle 10 equals $F_1 \times L$, $F_1$ being the force applied normal to handle 10 and L being the distance between the point of application of $F_1$ and the nut or bolthead 12. This force $F_1$ is directed to nut 12 by embracing arms 14 of the wrench head which each apply a force $F_2$ about a moment arm of length B passing through the center of the nut. Assuming that all of the torque applied to the handle 10 is transferred to the nut, and if the nut faces are parallel to the faces of arms 14, the total torque $F_1L$ equals $2F_2B$ or $F_2$ equals $F_1L/2B$. In a normal situation, as shown in FIG. 1, the nut faces are not perfectly parallel to the faces of arms 14, so that an angle alpha ($\alpha$) is formed therebetween. The length of the moment arm is thereby reduced, moment arm B in the situation illustrated in FIG. 1 being equal to the cosine of $\alpha$ times the length of a moment arm in an ideal situation in which the arms and nut faces are parallel. Thus, the greater the slippage within the wrench head or the rotation of the wrench head with respect to the nut, the greater is the size of angle $\alpha$ and the less is the torque $F_2\alpha\beta$ applied to nut 12 by each arm 14 for a given $F_1$. Because only two arms 14 are available to capture the nut, any spacing between one arm 14 and a nut face caused by burrs or imperfections or dirt will promote slippage to occur, especially in the presence of grease, thereby further increasing $\alpha$ and further reducing the moment arm applied to the nut. The greater is the angle $\alpha$, the greater the destructive forces that are applied to the nut corners and the greater the force $F_2$ must become to provide the required torque to the nut. This effect tends to round the corners of the nut eventually making it impossible to grip the nut at all. This effect also requires that the wrench head have a great deal of strength. The resulting thickness of the wrench head walls renders the wrench less maneuverable and less easy to use in limited space applications.

FIG. 2 shows a vector diagram of the typical forces associated with a prior art three sided pivotal wrench, such as that described in German Pat. No. 1,958,614, when used with a hexagonal nut. The vector diagram for this particular wrench is typical of other prior art unidirectional pivotal wrenches. The normal force applied to the handle 16 is $F_1$ and $L_1$ is the distance from the point of application of the force $F_1$ to the center of nut 20. Thus, the torque applied equals $F_1L_1$. The contact surface 22 on handle 16 engages the nut generally at the center thereof and applies a force generally normal to the face of the nut. This force, designated $F_R$, provides no torque to the nut at all, because it is directed towards the center of the nut. The only turning forces which are applied to the nut are found at the corners thereof and are designated $F_4$. The torque applied to nut 20 at each point equals $F_4A$ where A is the length of the moment arm passing through the center of the nut. In this instance, A optimally equals one-half the length of the nut face. It should be noted, that if $F_R$ is spaced from the center of the confronting nut face in a direction opposite of the direction of rotation, as sometimes happens, a negative torque would be applied, offsetting the torques applied by forces $F_4$. Assuming the total torque $F_1L_1$ applied to the handle equals the torque applied to the nut, and since torque is applied to the nut at only two points, $F_1L_1$ equals $2F_4A$ or $F_4$ equals $F_1L/2A$. The force $F_R$, since it is directed towards the center of the nut, must be opposed by a normal force equal thereto, $F_N$, by each of the opposed faces 21 and 23 and 25 of the wrench head. Thus, the actual force applied by each wrench head surface equals the turning force plus about $\frac{1}{2}F_R$. As a result, the wrench head must be sufficiently strong to withstand these forces requiring thick wrench head walls. These thick walls again render the above wrench difficult to use and maneuver in limited space applications.

FIG. 3 represents a typical vector diagram for a wrench of this invention when used with a hexagonal nut. In each embodiment of this invention, the interior surfaces of the wrench head opening engage a hexagonal nut 12 at three positions 29, 31 and 33 when a normal force $F_1$ is applied to the wrench handle 25 at a distance L from the center of the nut. At each position 29, 31 and 33, torque is applied to the nut 12 by the wrench head about a moment arm of length A passing through the center of the nut. Each position is disposed at an edge of a nut face in contact with an associated surface 27 of the wrench head opening and spaced from the center of the nut face in the direction of rotation of the nut so as to contribute a positive turning moment to the nut. If no gap exists between the confronting face 30 of the nut 12 and a contact surface 28 disposed on wrench handle 25, the torque $F_1L$ applied to the handle is equal to three times $F_5A$ where $F_5$ is the force applied at each position by a wrench head surface 27 to the nut and A is equal to one-half the length of the nut face. Thus, the force $F_5$ applied by each position 29, 31 and 33 is only two-thirds of the value of the force $F_2$ supplied by each arm of a two surface adjustable wrench, or by the interior surfaces of the unidirectional pivotal wrench head of FIG. 2 for a given applied torque $F_1L$. This fact means that less force is applied by each of the wrench head opening surfaces for a given force applied to the handle and the overall torque is applied more evenly to the nut. Thus the wrench head of this invention need not have the same strength as prior art wrenches for the application of a given torque, and it may have thinner wrench head walls, permitting the wrench of this invention to be more easily used and maneuvered in limited space applications.

For the case illustrated in FIG. 3A, where a gap $\Delta$ exists between the confronting face 30 of the nut 12 and the contact surface 28 of the wrench, the contact surface must be pivoted through an angle $\alpha_3$ to obtain a three point contact as shown in FIG. 3A. Since the contact surface 28 forms an equilateral triangle with the opposed surface of the wrench head opening, the value of $\alpha_3$ may be found from the relationship $\alpha_3=\beta_3-60°$, as shown in FIG. 3A, where $B_3$ is one angle of the equilateral triangle. Thus, $\alpha_3=\sin^{-1}[0.8660(1+\frac{2}{3}(A/w))]-60°$ where $\Delta$ equals the normal width of the gap and w is the width of the nut face 30. As the camming surface is pivoted through the angle $\alpha_3$, a force $F_6$ is applied to the corners of the nut about moment arm of length $N_3$. The ratio of this new force $F_6$ to the old force $F_5$ in a non-gap situation generated by a torque $F_1L_1$ equals $$\frac{F_6}{F_5}=\frac{1}{1-\sqrt{3\sin+3}}.$$

The ratio of the resulting force $F_6$ to the force $F_2$ for a two surface adjustable wrench generated by a torque $F_1L_1$ becomes $$\frac{F_6}{F_2}=\frac{2}{3}\ \frac{1}{1-\sqrt{3\sin\alpha_3}}.$$

The ratios $F_2/F_2$, $F_6/F_5$, $F_6/F_2$, and $F_6/F_2\alpha$ needed to produce a torque $F_1L_1$ are shown in the following Table I for a variety of gap ratios $\Delta/w$.

TABLE I

| $\frac{\Delta}{w}$ | $\frac{F_2}{F_2}$ | $\frac{F_6}{F_5}$ | $\frac{F_6}{F_2}$ | $\frac{F_6}{F_2}$ |
|---|---|---|---|---|
| 0.0 | 1.000 | 1.000 | .667 | .667 |
| 0.025 | 1.086 | 1.0546 | .703 | |
| 0.050 | 1.202 | 1.120 | .747 | .621 |
| 0.075 | 1.370 | 1.202 | .801 | |
| 0.100 | 1.644 | 1.306 | .870 | .529 |
| 0.125 | 2.219 | 1.445 | .963 | |
| 0.150 | 5.547 | 1.644 | 1.076 | .198 |
| | ↓ | | | |
| | ∞ | | | |
| 0.1547 | | 1.692 | 1.128 | |
| 0.1750 | | 1.964 | 1.310 | |
| 0.200 | | 2.611 | 1.741 | |
| 0.225 | | 5.547 | 3.700 | |
| 0.231 | | | | |

It can be seen that when the ratio $\Delta/w$ becomes as large as 0.1547, the arms of the two surface adjustable wrench can no longer engage the nut, while in the wrench of the present invention the wrench head surfaces not only engage the nut but the resulting force $F_6$ which is produced is only 13% larger than the minimum force for a two surface wrench having no gap. In addition, the ratio $F_6/F_2\alpha$ becomes progressively smaller as $\Delta/w$ increases up to 0.1547.

Each wrench of this invention is configured such that when the wrench head is placed on a nut or bolthead and a torque is applied to the handle, the handle of the wrench is angularly disposed with respect to a line drawn normal to a nut or bolthead face which confronts the handle and is engaged by a contact surface on the handle. This angular offset typically is in the range of $\theta=5°-10°$ and may be provided in one of several ways, as will be described. This offset permits greater flexibility in aligning the wrench head on a nut in limited space applications for rotation of the handle so that the space available is most efficiently utilized. In a situation without an offset, if access to the nut or bolthead is blocked from one position, the wrench can only be detented an amount equal to multiples of the angle circumscribed by the nut faces, which is 60° for hexagonal nut, as shown by lines 101 of FIG. 4. Lines 101 indicate the general alignment of the handle and are normal to the nut faces. In the wrench of the present invention having an offset, not only are multiples of the 60° detent available for a hexagonal nut, as shown by lines 103 of FIG. 4, but if the wrench is inverted, detenting positions equal to multiples of 60° minus twice the offset angle ($2\theta$) are also available for any given hexagonal nut or bolt head, as shown by lines 105 of FIG. 4. Similarly, for other size nut or bolt heads, the detenting angles available are equal to the angle circumscribed by the nut faces plus or minus the offset angle $\theta$ of the wrench. Thus, two ranges of detenting positions are provided. For an offset of 10°, a first range of 60° detents offset +10° from the normal is available as well as a second range of 60° detents offset −10° from the normal or −20° from the first range of detenting positions.

One embodiment of a wrench 30 of this invention exhibiting the abovedescribed properties will now be described with reference to FIG. 5. Wrench 30 includes a handle 32, which, if desired, may be provided with a longitudinal depression 34 to conserve material and to provide a convenient finger grip. A wrench head 36 is disposed on at least one end of handle 32, and a second wrench head 36 may also be provided on the opposite end of handle 32, although such a second wrench head is not necessary and would be provided only to accommodate a larger range of nut or bolthead sizes. Each wrench head 36 is pivotally connected to an end of handle 32 by a pivot pin 40. Pin 40 permits each wrench head 36 to pivot bidirectionally as desired. Pin 40 is disposed near the transverse center of handle 32 and is longitudinally spaced from the adjacent end of handle 32 a specified distance. Each wrench head 36 resides within a slot (not shown) formed between spaced, opposed shoulders 42 disposed on each end of handle 32. Shoulders 42 typically are formed with a notch 50 disposed at their center defining two spaced camming contact surfaces 45 on opposite sides of the notch which are adapted to engage a confronting face of a nut or bolthead within the wrench head opening 46 to drive opposed nut faces against adjacent interior surfaces of opening 46. Shoulders 42 are aligned to form an acute angle with respect to the transverse dimension of handle 32 to provide the desired offset previously described. In this manner, as handle 32 is pivoted to drive one set of surfaces 45 into contact with a face of a nut 12 within opening 46, handle 32 is offset an approximately equivalent acute angle from the position it would have if shoulders 42 were not angled.

The operation of this embodiment will now be described with reference to FIG. 5. Opening 46 of wrench head 38 is placed over the nut or bolthead 12 so that the faces of the nut or bolthead are generally parallel to the interior faces of opening 46. Handle 32 is then pivoted about pivot 40 with respect to wrench head 38 in one direction driving one set of surfaces 45 into contact with a confronting face of nut 12. As previously described, surfaces 45 contact the face of nut 12 adjacent one corner thereof and generally normal thereto. Recess 50 generally does not engage a nut face. The application of continued force to handle 32 in the same direction causes nut 12 to rotate in that direction. Once handle 32 has been pivoted as far as possible, the wrench is raised from nut 12 and is replaced in a new, desired position. The direction of rotation is reversed merely by reversing the direction of application of force to handle 32 so that the opposite set of surfaces 45 engages the face of nut 12 at the opposite corner thereof. If it is desired to detent the wrench through an angle of less than or more than a multiple of 60°, the wrench may be lifted from the nut and inverted, driving the opposite set of surfaces 45 into contact with an opposite, adjacent corner of the confronting face of nut 12.

Another embodiment of the bidirectional pivotable wrench is illustrated in FIGS. 6, 7 and 8. This wrench 60 is provided with a double pivot, which at its limit, as the two pivots are moved closer together, approaches the single central pivot of the wrench of FIG. 5. Wrench 60 includes a handle 62 and a wrench head 64 disposed on at least one end of handle 62 and having an opening 78. Wrench head 64 is disposed within a slot 66 formed between spaced, opposed shoulders 68 disposed on the end of handle 62. Formed on the upper exposed end of each shoulder 68 is a camming contact surface 76 which is positioned so as to confront opposed surfaces of opening 78. Surface 76 may also be provided with a notch 69 to define a two contact surfaces. Formed in one shoulder 68 on the outer transverse face thereof are a pair of curved slots **70*a* and 70*b* which are concave inwardly facing one another and which have the same general radius of curvature. Projecting through each slot 70*a* and 70*b* is a respective pivot pin 72*a* and 72*b* secured to a lower portion of wrench head 64 within slot 66. In its rest or netural position, each pin 72*a* or 72*b* resides in the upper portion of its slot closest to surface 76. Pins 72*a* and 72*b* are biased into this position by a spring or other biasing member 74, as shown in FIG. 8. Spring 74 is secured at one end to the lower portion of wrench head 64 generally intermediate pins 72*a* and 72*b* and is secured at its other end to the interior wall of the opposite shoulder 68 within slot 66 closely adjacent camming surface 76. The upper portion of each slot 70*a* and 70*b* serves as a stop limiting movement of respective pins 72*a* and 72*b* toward surface 76 and serving as a point about which the wrench head pivots with respect to the handle. In operation, torque applied to handle 62 in one direction causes wrench head 64 to pivot with respect to handle 62 about one pivot pin 72*a* at the upper portion of its slot 70*a* while the other pivot pin 72*b* rides downwardly away from surface 76 within its associated slot 70*b* until surface 76 engages a confronting face 12*a* of nut 12. Continued application of force to handle 62 causes rotation of nut 12 in that direction, as previously described. Handle 62 of this embodiment may be straight but preferably it is formed with a slight angular bend adjacent wrench head 64, as shown in FIG. 6. The angle of the bend typically is in the range of 5° to 10° with respect to the longitudinal orientation of handle member 62** and provides the 5° to 10° desired offset previously described.

Operation of the wrench of FIGS. 6–8 will now be discussed with particular reference to FIG. 7 schematically illustrating the vector forces. For purposes of illustration, handle 62 is shown pivoted in a clockwise direction, although it is understood that the forces shown and the relationships developed herein will be the same for a counterclockwise rotation. For a clockwise rotation, pivot pin **72*a* serves as the point about which wrench head 64 pivots with respect to the handle 62, while pivot pin 72*b* rides downwardly within its slot 70*b*. Typically, surface 76 is aligned generally parallel to the confronting face 12*a* of nut 12 in the neutral position. Again, the normal torquing force is designated by $F_1$ and the effective length, which is designated $L_1$, is the distance from the point of application of $F_1$ to the center of the nut, and the applied torque T equals $F_1L_1$. The force applied by surface 76, $F_R$ is generally normal to face 12a and A is the length of the moment arm, which is generally one-half the width of face 12a, and $F_3$ is the force applied to the nut by the wrench head at the other two points opposite surface 76**. Thus, the torque applied to the nut is given by $T=2F_3A+F_RA$, and $$F_R = F_1L_1 = \frac{F_1L_1}{A} - 2F_3.$$

Since the force $F_R$ is generated by pivoting the wrench head about pin 72a, $F_RB=F_1L_2$, where B is the moment arm about pin 72a or the normal distance between pin 72a and the point of contact between surface 76 and face 12a, and $L_2$ is the length of the moment arm from pin 72a to the point of application of the force $F_1$. Thus, $F_R=F_1L_2/B$ where the ratio $L_2/B$ is the effective leverage ratio of the camming action. For the handle to remain pivoted, the force $F_R$ must offset the opposing force $F_0$, shown in FIG. 7. $F_0$ equals $2(F_3 \sin +°)$ or $F_3$. Thus, $F_R \geqq F_0 \geqq F_3$. Rearranging the equations, $F_1=F_RB/L_2$, and $F_R=(F_RB/L_2)(L_1/A)-2F_3$, or $$F_R\left[\frac{L_1}{L_2}\ \frac{B}{A} - 1\right] = 2F_3.$$

Since $F_R \geqq F_3$, $F_R/F_3 \geqq 1$ and $$\frac{F_R}{F_3} = \frac{2}{\left(\frac{L_1}{L_2}\ \frac{B}{A}\right) - 1} \geqq 1$$

and $$\frac{B}{A} \leqq \frac{3L_2}{L_1}.$$

Assuming conservatively that $$\frac{L_2}{L_1} = .8, \frac{B}{A} \leqq 2.4.$$

The worse case for the ratio of B/A exists for the smallest nut with which a given wrench is adapted to be used. If the moment arm for the largest nut with which the particular wrench is used is given by $A_L$ while that for the smallest nut is given by $A_S$, a typical wrench of this invention has a ratio of $A_L/A_S=1.4$. Thus, for the smallest nut $B/A \geqq 2.4$ and for the largest nut, $B/A=2.0$, and for $A_L/A_S=1.4$, the pivot pins 72a and 72b should be located beneath the corners of the largest nut with which the wrench is to be used. For a non-ideal case where $F_R$ is not normal to face 12A, the ratios of B/A will be reduced. In the situation where the force is applied at an angle of 30°, $F_R$ is directed towards the center of the nut and no rotational torque is applied to the nut. In such an instance, B/A is less than 1.2. Thus, adherence to the above values for B/A for $A_L/A_S=1.4$ insures that the rotational torque applied to the nut is optimized and that the forces tending to distort the nut and wrench head are minimized.

Another embodiment of the wrench of this invention will not be described with reference to FIGS. 9 through 12. Wrench 91 includes an elongated handle 90 having a wrench head 92 rigidly secured to at least one end thereof. Wrench head 92 has an opening 94 formed by wall portions 96 disposed in spaced relationship with a movable jaw 98 having a face 100 formed thereon confronting wall portions 96. Jaw 98 is disposed on the end of a threaded shaft 99 which extends longitudinally along handle 90. Shaft 99 passes through a threaded hole 97 in adjustment screw 102 on handle 90, and threads on the outer surface of shaft 99 mate with the threads on interior surfaces of the screw hole. Rotation of screw 102 serves to either advance jaw 98 towards wall portions 96 to capture a nut within opening 94, as shown in FIG. 11, or to withdraw jaw 98 away from wall portions 96 to permit removal of the wrench head from nut 12.

As in the previously described embodiments, wrenchhead 92 is preferably offset with respect to handle member 90, typically an angle of 5° to 10°. This offset is produced by providing surface 97 of wall portions 96 with an equal angle with respect to the transverse dimension of handle 90 and by rotating the other surfaces of wall portions 96 accordingly. Also, jaw face 100 is sloped at an equal acute angle with respect to the transverse dimension of handle 90 to accommodate the offset so that jaw face 100 is generally parallel to a confronting face 12a of nut 12 at all times to insure the three point application of rotational torque previously described. As a result of this offset, as shaft 99 is advanced towards wall portions 96, jaw 98 shifts slightly with respect to wall portions 96 in a transverse direction parallel to jaw face 100 or to the right as shown in FIG. 11. Jaw face 100 is made sufficiently wide so that jaw face 100 extends along at least the entire transverse width of nut face 12a for all size nuts and at all times. The fact that jaw 98 shifts transversely as it is advanced and retracted does not adversely affect the three point application of torque or alter the operation of this wrench as described in FIG. 3, so as long as jaw face 100 is made sufficiently wide to accommodate this movement for all size nuts with which the wrench is to be used.

Another configuration of this embodiment is shown in FIG. 12, in which wrench head 92 is formed having two, hinged portions 104 and 106. Portion 104 is formed integrally with or secured to handle 90 and forms the lower boundary of opening 94. Upper portion 106 contains wall portions 96 and defines the upper boundary of opening 94. Upper portion 106 is connected to lower portion 104 by hinge 108 along one lateral side and by latch 110 along an opposed lateral side. Typically, latch 110 includes an arm 112 which is pivotally secured to lower portion 104 and arm 112 has a sharply angled projection 114 at one end adapted to engage a mating angled notch 116 formed on the outer surface of upper portion 106. To open wrench head 92 to permit insertion of a nut or bolthead, end 118 of arm 112 is depressed, pivoting arm 112 and driving projection 114 out of notch 116, thereby releasing upper portion 106 to allow opening of the wrench head about hinge 108. To lock wrench head 92, upper portion 106 is pivoted about hinge 108 into a closed position as shown in FIG. 12, and projection 114 is driven into notch 116. Arm 112 may be provided with a spring biasing arm 112 into the closed position so that as upper portion 106 is driven downwardly, projection 114 rides along the outer surface of upper portion 106 adjacent notch 116, pivoting arm 112 away from upper portion 106 until projection 114 slides into the notch. The spring bias applied to the arm 112 locks projection 114 in notch 116. During operation of the wrench of this embodiment, torque applied to wrench head 92 in either direction tends to pivot upper portion 106 away from lower portion 104 about hinge 108, more securely locking projection 114 within notch 106 to prevent separation of upper portion 106 from lower portion 104.

Another embodiment of this invention will now be described with reference to FIGS. 13 through 15. With particular reference now to FIG. 13, wrench 120 includes an exterior handle housing 122 and at least one wrench head 124 disposed on an end of housing 122. Typically, one wrench head 124 is provided on each end of housing 122, as shown in FIG. 13, but a wrench having only one wrench head is included within this invention as well. Each end of housing 122 is provided with a slot 132 bounded by shoulders 129 through which wrench head 124 extends. Each wrench head 124 includes an opening 126 bounded by surfaces 128 on wrench head 124 and by contact surface 130 formed on shoulders 129 in confronting relationship with surfaces 128. Contact surface 130 extends through opening 126 and bridges slot 132 between shoulders 129.

Housing 122 is movable longitudinally with respect to each wrench head 124 by means of adjustment screw 140. Thus, as screw 140 is rotated in one direction, housing 122 is advanced toward one wrench head 124 and away from the wrench head 124 on the opposite end of housing 122. The contact surface on one end of housing 122 is advanced toward its associated surfaces 128 to render its associated opening 126 smaller to accommodate a smaller nut or bolthead, while the contact surface 130 at the opposite end of housing 122 is retracted away from associated surfaces 128 to render its opening 126 larger to accommodate a larger nut or bolthead. Once the appropriate size opening has been obtained this setting is maintained by restraining screw 140 and utilizing the mechanical advantage thereof, so that wrench head 124 will not slip about a nut 12 during rotation thereof. Handle housing 122 is typically angularly offset with respect to wrench head 124 as described for previous embodiments so that contact surface 130 and surface 128A form an angle in the range of 6° to 10° with respect to the transverse dimension of the handle.

Wrench head 124 may be fixedly mounted at a predetermined offset with respect to handle housing 122 as shown in FIG. 15, or it may be pivotally mounted with respect thereto and biased into a neutral position as shown in FIG. 14. In the pivotable configuration, an elongated plate 142 having a T-shaped projection 144 disposed on each end thereof is disposed within housing 122. Projection 144 includes flared ends 146 and associated notches 148 formed on either side thereof beneath ends 146. Each wrench head 124 is provided with an associated T-shaped cutout having projections 150 which are adapted to extend into notches 148 and an opening 152 into which ends 146 extend. An elastic material or spring 154 is captured between upper surfaces of projection 144 and an inwardly facing surface of opening 152 and serves to bias the wrench head into a neutral or non-pivoted position during non-use but which is sufficiently resilient to allow pivoting of wrench head 124 with respect to plate 142 when torque is applied thereto. The tolerances of opening 152 and projection 144 are sufficient to permit a limited range of pivotal movement of wrench head 124 about plate 142. Typically in its non-pivoted position, wrench head 124 is angularly offset with respect to plate 142 and handle housing 122 by an angle of 5° to 10°. This offset is provided by the similar angular disposition of projection 144 with respect to plate 142. Plate 142 is captured between opposed faces 122*a* and 122*b* of the handle housing which are clamped together typically by means of screws 154. Longitudinal slots 156 are provided in plate 142 for screws 154 to permit longitudinal movement of plate 142 with respect to housing 122. An enlarged longitudinal slot 158 is disposed in the center of plate 142, and threaded shaft 160 resides therein in fixed relation to plate 142. Threadably disposed on shaft 160 is screw 140, the outer perimeter of which extends through openings 162 in each face 122*a* and 122*b* of housing 122, as shown in FIG. 13. Slot 158 is sufficiently wide and long to accommodate screw 140 therein so that screw 140 does not engage plate 142 along radial edges thereof. Shoulders 164 at each end of slot 158 serve as stops to limit longitudinal movement of screw 140 with respect to shaft 160. As screw 140 is rotated with respect to shaft 160, the axial ends of screw 140 abut shoulders 165 at one end of openings 162 causing plate 142 and thus wrench heads 124 to shift longitudinally with respect to faces 122*a* and 122*b* of housing 122 to cause adjustment of openings 126.

The non-pivotal configuration of this embodiment is illustrated in FIG. 15. Since FIG. 14 is nearly identical to FIG. 15, like numbers will be used for like parts where possible. In this embodiment, wrench heads 124 and plate 142 are formed in a unitary piece 170. Wrench heads 124 are angularly disposed with respect to the longitudinal length of piece 170 by the desired offset, typically 5° to 10°. Piece 170 is captured between faces 122*a* and 122*b* by screws 154 as previously described. Shaft 160 resides in slot 158 and produces longitudinal movement of piece 170 as described. In all other respects, the operation of the embodiment of FIG. 15 is identical to that of FIG. 14 and will not be further described.

Each of the embodiments of the wrench of this invention can be used with a wide range of nut or bolthead sizes because of its continuously adjustable nature. Furthermore, each embodiment of the wrench of this invention can be formed with an offset of the wrench head with respect to the wrench handle in the range of 5°–10° to permit two ranges of detenting positions during use. The three points of engagement of the nut or bolthead by the wrench head provide optimal application of torque to the nut or bolthead and permit the construction of a wrench having less strength and thinner wrench head walls than wrenches in the prior art. This feature renders the wrench more maneuverable and easier to use in limited space, high torque applications. The configuration of each embodiment minimizes any air gap formed between contact surfaces of the wrench and faces of the nut or bolthead and applies torque to the nut at the edges thereof, thus providing greater rotational torque thereto. As a result, rounding of the nut or bolthead does not occur and a negative or offsetting torque is never applied to the nut or bolthead.

The wrenches of this invention may have any size desired, depending upon the particular task for which they are to be used. In addition, although the drawings have shown the wrench heads in a hexagonal configuration, the wrench heads of each embodiment of this invention may have any shape desired depending upon the shape or nature of the rotatable member with which they are to be used. The hexagonal configuration is for purposes of illustration only. The wrench and wrench-heads typically are formed of a metal, and any suitable metal can be used. For instance, because of the optimal torque application, some of the wrenches may be formed of lightweight aluminum while steel may also be used. They can be manufactured either by a blanking or stamping process or by a casting process or by drop forging or by any other process known to those skilled in the art.

For the wrench of FIGS. 13 through 15, the smaller wrench head typically is adapted to accommodate nuts in the range of sizes from 11 mm to 17 mm, including the standard sizes of 7/16ths of an inch, 8/16ths of an inch, 9/16ths of an inch and 10/16ths of an inch. The large end is typically configured to include a range of sizes from 17 mm to 14/16ths of an inch, including the 17 mm and 25/32nds of an inch standard sizes. Thus, the one wrench can be utilized over a range of 21 standard nut sizes.

The above description is exemplary, and modifications and improvements are intended to fall within the scope of this invention as defined solely in the following claims.

What is claimed is:

1. A wrench for turning all nuts having a number of planar faces and a predetermined maximum size comprising:

an elongate handle having a contact surface disposed on at least one end thereof, said surface operative to engage a confronting face of said nut adjacent one corner thereof and generally normal said confronting face;

a wrench head disposed on said one end of said handle and having an opening therein for insertion of said nut, the size of said opening being adjustable to accommodate a range of sizes of nuts, said opening having opposed interior surfaces in spaced confronting relationship with said contact surface, said wrench head being angularly disposed with respect to said handle; and means for urging said contact surface into engagement with said confronting face of a nut disposed within said opening to capture the nut between said contact surface and said opposed surfaces to permit the transfer of torque applied to said handle from said contact surface and said opposed surfaces to the faces of said nut at three points, each of said three points being spaced from the center of its associated nut face, said engaged corner being that which is to the side of the nut which is in the same direction as the direction of rotation of said handle.

2. The wrench of claim 1 wherein one end of said handle is angularly disposed with respect to said wrench head by an angle in the range of 5°–10° when said contact surface is in engagement with said face of said nut.

* * * * *